US008453286B2

(12) United States Patent
Kenna

(10) Patent No.: US 8,453,286 B2
(45) Date of Patent: Jun. 4, 2013

(54) HAIR BRUSH

(76) Inventor: Lisa Kenna, Boca Raton, FL (US)

( * ) Notice: Subject to any disclaimer, the term of this patent is extended or adjusted under 35 U.S.C. 154(b) by 860 days.

(21) Appl. No.: 12/460,807

(22) Filed: Jul. 24, 2009

(65) Prior Publication Data

US 2010/0017991 A1 Jan. 28, 2010

Related U.S. Application Data

(60) Provisional application No. 61/135,801, filed on Jul. 24, 2008.

(51) Int. Cl.
*A46B 9/00* (2006.01)

(52) U.S. Cl.
USPC ..... 15/160; 15/159.1; 132/120

(58) Field of Classification Search
USPC ..... 15/159.1, 160, 207.2, 106; 132/120
See application file for complete search history.

(56) References Cited

U.S. PATENT DOCUMENTS

| | | | | | |
|---|---|---|---|---|---|
| 3,459,199 | A | * | 8/1969 | Connell | 132/119.1 |
| 3,727,260 | A | | 4/1973 | Spydevold et al. | |
| 3,949,765 | A | | 4/1976 | Vallis | |
| 4,211,217 | A | * | 7/1980 | Gueret | 601/137 |
| 4,475,261 | A | | 10/1984 | Okumura et al. | |
| 4,593,708 | A | * | 6/1986 | Goeller et al. | 132/212 |
| 4,619,012 | A | * | 10/1986 | Wachtel | 15/187 |
| 4,722,111 | A | | 2/1988 | Brodey et al. | |
| 5,220,702 | A | | 6/1993 | Howell et al. | |
| D341,718 | S | * | 11/1993 | Briganti | D4/136 |
| 5,657,775 | A | * | 8/1997 | Chou | 132/125 |
| 6,178,583 | B1 | | 1/2001 | Volpenhein | |
| D473,717 | S | | 4/2003 | Park | |
| D504,235 | S | | 4/2005 | Kuo et al. | |
| D504,572 | S | | 5/2005 | Kuo et al. | |
| D504,776 | S | | 5/2005 | Kuo et al. | |
| D510,483 | S | | 10/2005 | Kuo | |
| D518,644 | S | | 4/2006 | Park | |
| 7,810,509 | B2 | * | 10/2010 | Kuzuu | 132/218 |
| 2003/0088932 | A1 | * | 5/2003 | Gardiner | 15/167.1 |
| 2003/0221271 | A1 | * | 12/2003 | Edwards et al. | 15/159.1 |
| 2006/0236484 | A1 | * | 10/2006 | Lee | 15/167.1 |

* cited by examiner

*Primary Examiner* — Laura C Guidotti
(74) *Attorney, Agent, or Firm* — Daniel C. Crilly, Esq.; GrayRobinson, P.A.

(57) ABSTRACT

A hair brush is shown and disclosed. The hair brush has a row of loops on the first side running from near the handle to the top mounted in a retention material. Next to the row of loops, is located a row of bundles of boar bristles. These groupings of boar bristles are a bundle of individual boar bristles mounted in the retention material. This alternating pattern of lines or rows of loops and bristles continues to the other side of the brush and the last row near the second side is a row of loops. The loops can be configured such that they are parallel to the sides or the top. These rows of loops on the sides of the hair brush help to keep the hair brush from pulling on and possibly damaging the hair extensions that have been installed into a users natural hair. The bundles of boar bristles provide additional shine and manageability to the hair. Also shown is an arrangement of a single loop surrounded by a plurality of bristles and mounted in the retention material. The base of the brush can take many different shapes such as round, semi-circular, square and rectangular. The base can vary in size, wherein the base is large for salon use and smaller for personal carry use. The density of the loops and bristles can also be varied dependent upon the design criteria and type of hair or hair extensions.

12 Claims, 3 Drawing Sheets

HAIR BRUSH

PRIORITY

This application claims priority from Provisional Application for Patent Ser. No. 61/135,801 with a filing date of Jul. 24, 2008

FIELD

The present versions of these embodiments relate generally to the field of hair brushes and specifically hair brushes used by persons who have hair extensions attached to their natural hair.

BACKGROUND

These embodiments relate to hair brushes, and more particularly to hair brushes used by persons who have had hair extensions installed into their natural hair.

Many persons have short hair and cannot for one reason or another grow their hair long or wish that they had long hair for a specific event. Many times these persons desirous of long or longer hair have hair extensions installed or applied. This can be a time-consuming process and they do not wish to pull out or possibly damage their natural hair or any hair extensions that they have installed in their natural hair when styling or brushing. These individuals also need to brush and style their hair with the extensions installed. A great many of the hair brushes in the background art are not designed for brushing or styling natural hair that has had hair extensions installed. These background art brushes can cause snags or pulling of the hair extensions from the natural hair and damage either the hair extensions or the natural hair.

There is a need for a hair brush that can be used by one having hair extensions installed in their natural hair that will not damage the hair extensions or their natural hair by pulling the extensions from the natural hair.

The device described shows a unique design of alternating loops and straight boar hair bristles or surrounding loops with boar hair bristles that aid in the brushing and styling of natural hair with hair extensions installed.

For the foregoing reasons, there is a need for a unique brush that has alternating loops and straight boar bristles or loops surrounded by boar bristles to enhance the shine and lessen the possibility of damage to the installed hair extensions and the user's natural hair.

These together with other goals of these embodiments, along with various features of novelty which characterize these embodiments, are pointed out with particularity in the remaining portions of this disclosure. For a better understanding of these embodiments and the operating advantages, reference should be had to the accompanying drawings and attached descriptive matter.

DETAILED DESCRIPTION OF THE EMBODIMENTS

Figure 1:
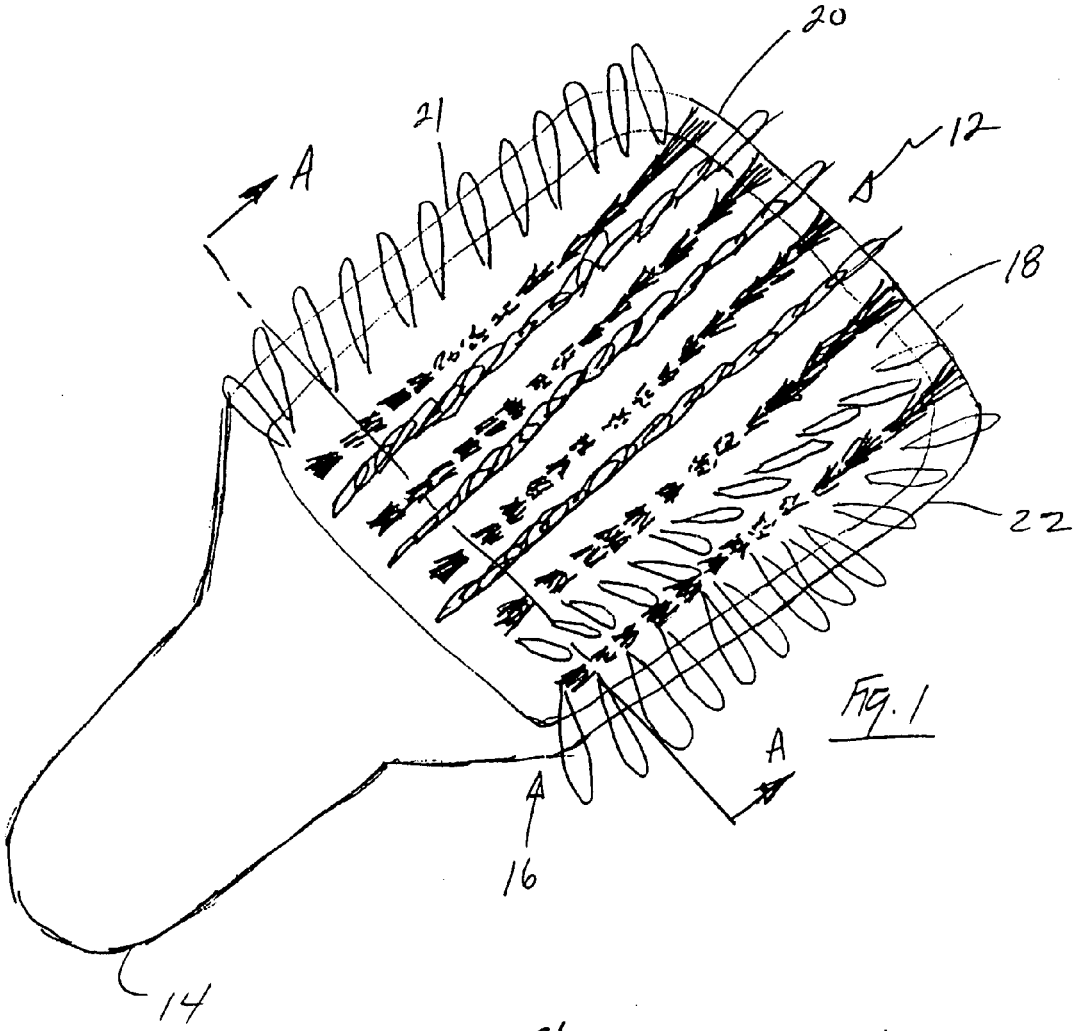
FIG. 1 shows a perspective view of one embodiment of the hair brush.

Referring to the drawings in detail wherein like elements are indicated by like numerals, there is shown in FIG. 1 a hair brush 12. The hair brush 12 has a handle 14 opposite a top 20, a first side 21 and a second side 22. The brush 12 has a base 16 containing and affixed to a retention material 18. The retention material 18 is affixed to the base and holds one end of the bristles 26 and both ends of the loops 24 fixed such that the bristles 26 and loops 24 extend from the retention material 18 and can be used to brush a user's hair (not shown). The loops 24 can be secured such that the loops 24 open in a manner parallel to the sides 21, 22 or arranged such that the loops 24 open in a manner parallel to the top 20.

It should be noted that one end of the bristles 26 are fixed in retention material 18 and the opposite end of the bristles 26 extend from the retention material. The retention material 18 is fixed to the base 16 and sides of some of the disclosed embodiments. Both ends of the loops 24 are retained within the retention material 18 forming the loop that extends from the retention material 18 as shown and described herein.

The loops 24 and bristles 26 are mounted in the retention material 18 in a certain arrangement to aid the hair brush 12 in moving through the hair extensions and natural hair when brushing natural hair with hair extensions attached.

Near the first side 21 and running from near the top 20 to near the handle is a plurality of loops 24 mounted in retention material 18. The loops 24 are approximately in a straight row near the first side 21. Next to the row of loops 24, is located a row of bundles of bristles 26, FIG. 2, also mounted in the retention material 18. Likewise this row of bundles of bristles 26 run from near the top 20 to near the handle 14 and are mounted in the retention material 18. Next to this row of bundles of bristles 26 is located another row of loops 24 and this pattern continues until the second side 22 is reached. The final row near the second side 22 is a final row of loops 24. The row of loops 24 on each side of the base are needed to prevent the hair brush 12 from snagging the hair extensions. As can be seen, the length of the bristles 26 is shorter than the length of the loops 24.

These alternating rows of loops 24 and bundles of bristles 26 allow the brush to move more easily and with less snagging through natural hair with hair extensions. The loops 24 can be made from a polymeric material and are essentially a fixed diameter line which is flexible enough such that the loop can be formed and the ends of the loop 24 are fixed in and held by the retention material 18. The loops 24 are used to help prevent tangling and discourage catching or pulling on the hair extensions and possible breakage. The loops 24 allow the brush to move easily through the hair with hair extensions attached while still allowing styling of the natural hair and hair extensions.

The bundles of bristles 26 are made from boars' hair and a bristle 26 is generally a collection or grouping of several pieces of relatively straight boar's hair forming the bundles. Boars' hair was chosen for the bristles 26 as this provides additional shine and manageability to the hair while minimizing the chances of pulling or damaging the hair extensions installed in a user's natural hair. The boars' hair bristles 26 also help prevent breakage caused by brushes having loops 24 alone.

The retention material 18 is a material known in the art for receiving bristles 26 and loops 24 and retaining them so that the hair brush 12 can be used.

FIG. 1 shows a perspective view of the hair brush with the loops 24 and bristles 26 attached.

Figure 2:
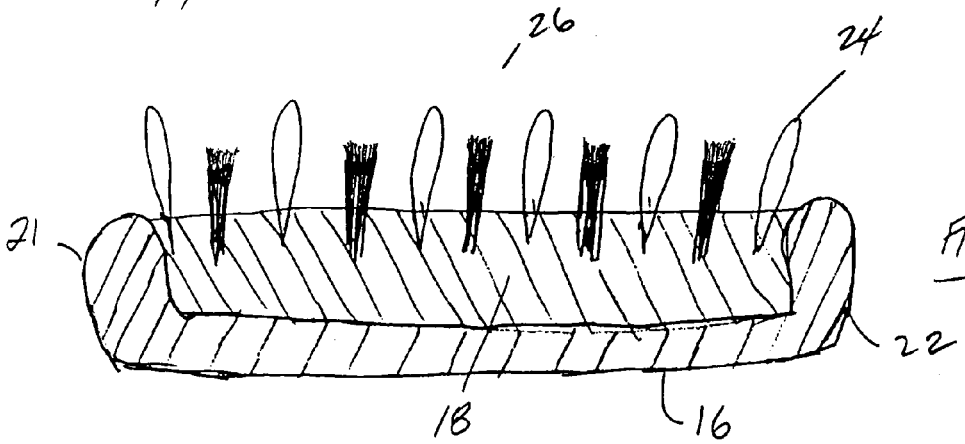
FIG. 2 shows a cross sectional view of one embodiment of the hair brush along A-A of FIG. 1.

FIG. 2 shows six rows of loops 24 with five rows of bristles 26 between the first side 21 and second side 22. This configuration is but one embodiment of the hair brush 12, obviously the number of rows of loops 24 and bristles 26 is governed by the size of the base 16 of the hair brush 12. The spacing of the loops 24 between the handle 14 and the top 20 can vary also depending upon the size of the base 16. The type of hair that the brush 12 is being manufactured for also effects the spacing of the loops 24. Likewise, the spacing of the bristles 26 between the handle 14 and the top 20 can vary depending upon the size of the base 16. The type of hair that the brush 12 is being manufactured for also effects the spacing of the bristles 26.

Obviously, various types of and designs of base 16 can be manufactured. There could be rectangular or square bases 16. The bases 16 could be large for salon use or small in sized for travel or personal carry. The bases 16 could also be manufactured from a polymer, wood, or metal.

The bases 16 could be round with loops 24 and bristles 26 around the circumference and extending from near the handle 14 to the top 20. The bases could also be of a semicircular design with loops 24 and bristles 26 partially around the circumference extending from the handle 14 to the top 20. In these embodiments, the retention material 18 would surround and be affixed to the base 16. Likewise, the loops 24 and bundles of bristles 26 would be affixed in the retention material 18 as shown in FIGS. 5 and 6.

Figure 3:
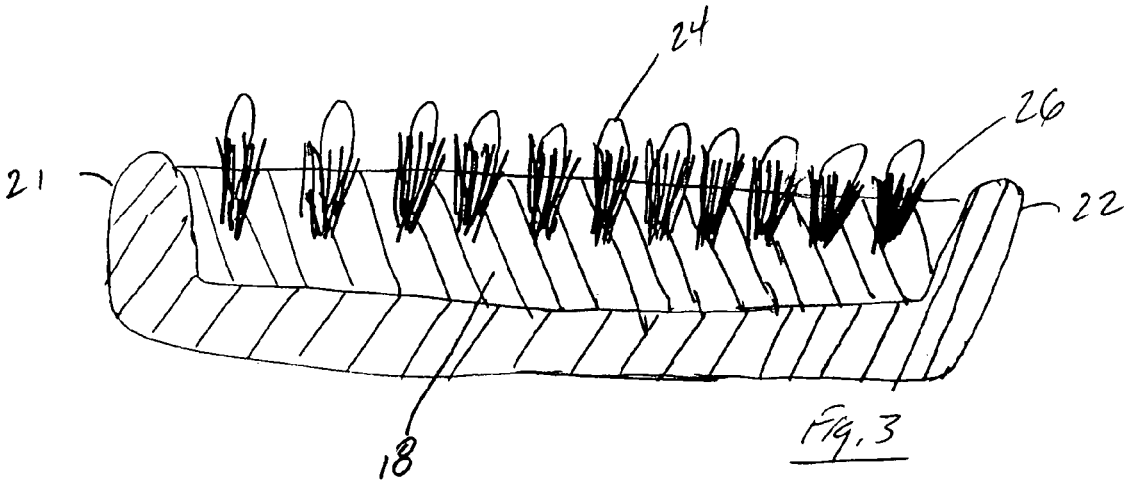
FIG. 3 shows a cross sectional view of another embodiment of hair brush along C-C of FIG. 4 having an alternative arrangement of the loops and bristles.
Figure 4:
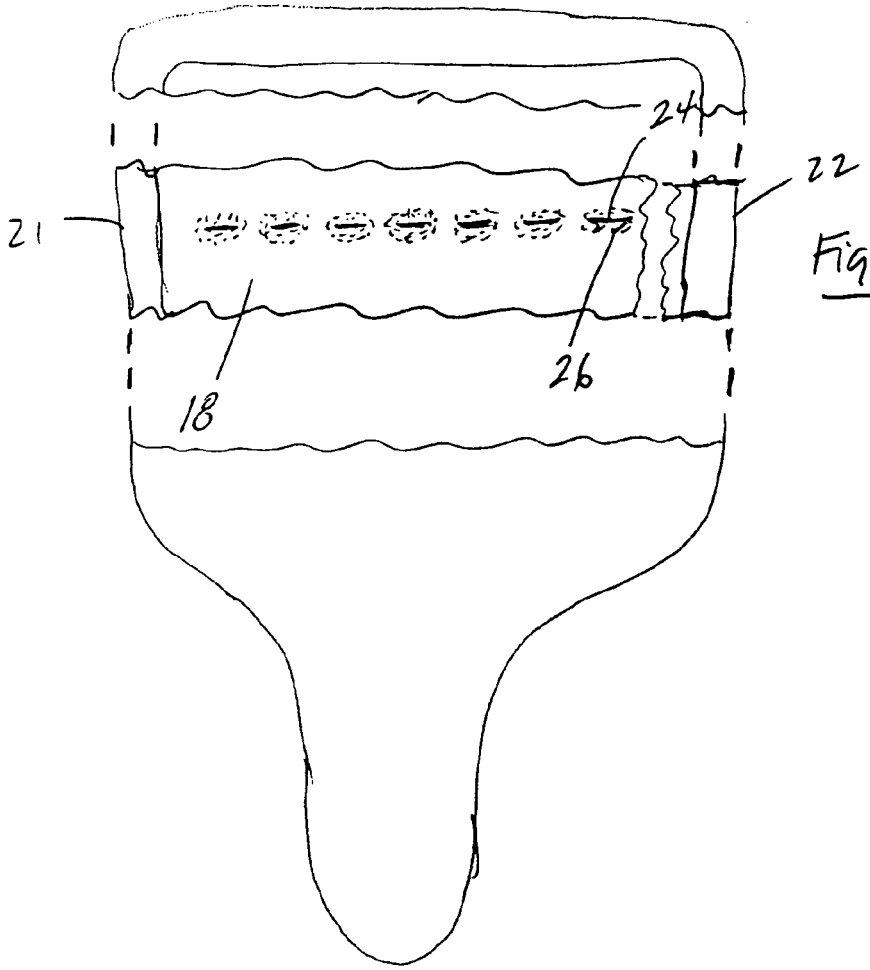
FIG. 4 shows a top partial view of another embodiment with an alternative arrangement of loops and bristles.

FIG. 3 shows a cross sectional view along C-C of FIG. 4 of an alternative embodiment of the arrangement of the loops 24 and bristles 26. In this embodiment, the loop 24 is seated and retained in the retention material 18. The loop 24 is surrounded by the bristles 26 in a circular pattern such that the bristles 26 are retained in the retention material 18 and surround the entire loop 24. In this embodiment, the bristles 26 are shorter than the loops 24.

FIG. 4 shows a partial cross section top view of the embodiments shown in FIG. 3. In FIG. 4, it can be seen that the loop 24 is located approximately in the center of a plurality of bristles 26.

Figure 5:
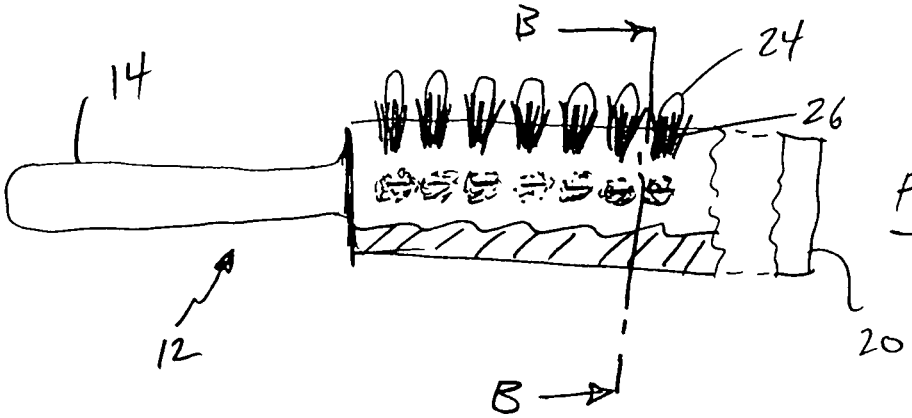
FIG. 5 shows a partial side view of an embodiment showing the arrangement of loops and bristles configured on a round brush.
Figure 6:
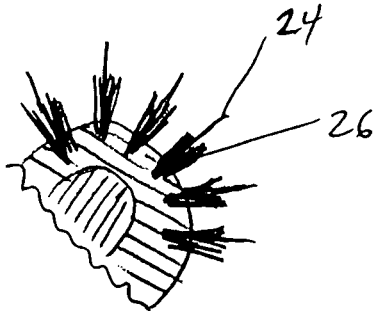
FIG. 6 shows a partial sectional view of the embodiment shown in FIG. 5 along B-B.

FIG. 5 shows an arrangement of the loops 24 and bristles 26 on a brush 12 that is round. FIG. 6 shows a partial section view of the embodiment shown in FIG. 5 along line B-B. The embodiments of the round brush shown in FIGS. 5 & 6 could also be manufactured having a larger or smaller diameter depending upon the application for which it is designed. Obviously a larger diameter would result in more loops 24 and bristles 26 around the circumference of the brush 12.

It will now be apparent to those skilled in the art that other embodiments, improvements, details and uses can be made consistent with the letter and spirit of the foregoing disclosure and within the scope of this application.

What is claimed is:

1. A hair brush for use in natural hair with hair extensions installed, the hair brush comprising:

a handle;

a base;

retention material installed in the base; and alternating, parallel rows of loops and bristles arranged such that ends of the loops and unexposed ends of the bristles are retained within the retention material, wherein the loops are longer than the bristles.

2. The hair brush of claim 1, wherein the base defines a first side end and a second side end, and wherein the loops open such that the loops are parallel to the first and second side ends of the base.

3. The hair brush of claim 1, wherein the base defines a top end and wherein the loops open such that the loops are parallel to the top end of the base.

4. The hair brush of claim 1, wherein the base defines a top end, a first side end and a second side end, wherein the rows of loops and bristles are disposed across the base from the first side end to the second side end such that the rows extend in a direction from the top end of the base to the handle, wherein one row of loops is parallel to and adjacent the first side end of the base, and wherein another row of loops is parallel to and adjacent the second side end of the base.

5. A hair brush for use in natural hair with hair extensions installed, the hair brush comprising:

a handle;

a base;

retention material installed in the base; and rows of loops arranged such that each loop is surrounded by a respective bundle of bristles, wherein ends of the loops and unexposed ends of the bristles are retained within the retention material, and wherein the loops are longer than the bristles.

6. The hair brush of claim 5, wherein the base defines a first side end and a second side end, and wherein the loops open such that the loops are parallel to the first and second side ends of the base.

7. The hair brush of claim 5, wherein the base defines a top end and wherein the loops open such that the loops are parallel to the top end of the base.

8. The hair brush of claim 5, wherein the bundle of bristles forms a circular pattern around each loop.

9. The hair brush of claim 5, wherein each loop is located approximately in a center of the bundle of bristles.

10. A hair brush for use in natural hair with hair extensions installed, the hair brush comprising:

a handle;

a round base attached to the handle;

retention material affixed to the base; and alternating, parallel rows of loops and bristles arranged such that ends of the loops and unexposed ends of the bristles are retained within the retention material, wherein the loops are longer than the bristles.

11. The hair brush of claim 10, wherein the base defines a top end and wherein the loops open such that the loops are parallel to the top end of the base.

12. The hair brush of clam 10, wherein the base defines a top end and wherein the rows of loops and bristles are disposed across the base such that the rows extend in a direction from the top end of the base to the handle.

* * * * *